US010106229B2

(12) United States Patent
Meyers et al.

(10) Patent No.: US 10,106,229 B2
(45) Date of Patent: Oct. 23, 2018

(54) WATERCRAFT SEAT

(71) Applicants: Brittany A. Meyers, Arlington Heights, IL (US); Scott F. Meyers, Arlington Heights, IL (US)

(72) Inventors: Brittany A. Meyers, Arlington Heights, IL (US); Scott F. Meyers, Arlington Heights, IL (US)

( * ) Notice: Subject to any disclaimer, the term of this patent is extended or adjusted under 35 U.S.C. 154(b) by 146 days.

(21) Appl. No.: 14/856,055

(22) Filed: Sep. 16, 2015

(65) Prior Publication Data

US 2017/0073045 A1 Mar. 16, 2017

(51) Int. Cl.
*B63B 29/04* (2006.01)
*B63B 35/71* (2006.01)

(52) U.S. Cl.
CPC ..... *B63B 29/04* (2013.01); *B63B 2029/043* (2013.01); *B63B 2035/715* (2013.01)

(58) Field of Classification Search
CPC B63B 29/04; B63B 35/74; A47C 9/10; A47C 15/006
See application file for complete search history.

(56) References Cited

U.S. PATENT DOCUMENTS 1,595,096 A 8/1926 Hooker ..... 114/354
1,740,949 A * 12/1929 Luery ..... A47D 13/105 297/174 R
1,794,417 A 3/1931 Ernest ..... 114/77 R
1,891,491 A 12/1932 Anderson ..... 114/345
2,600,757 A * 6/1952 Grimston ..... B63B 7/06 114/345
2,712,293 A 7/1955 Michael ..... 114/39.22
2,815,517 A * 12/1957 Andresen, Jr. ..... B63B 3/00 114/363
3,290,089 A * 12/1966 Farrell ..... A47C 4/48 297/188.02
3,473,502 A 10/1969 Wittkamp ..... 114/61.23
3,497,885 A 3/1970 Scholle ..... 114/354
3,718,365 A 2/1973 Gibson ..... 297/344.24
4,496,325 A 1/1985 Tweg ..... 440/26
4,646,669 A * 3/1987 Frank ..... B63B 15/00 114/347
4,662,298 A * 5/1987 Strahle ..... B63H 9/1007 114/363
4,672,911 A * 6/1987 Hodgins ..... B63H 16/06 114/363
4,700,648 A 10/1987 Trefethern ..... 114/61.24
4,796,555 A 1/1989 Chang ..... 114/39.26
5,101,753 A 4/1992 Hul ..... 114/345
5,168,825 A * 12/1992 Ring ..... B63B 29/04 114/363
5,411,425 A 5/1995 Rinker ..... 441/130
(Continued)

*Primary Examiner* — S. Joseph Morano
*Assistant Examiner* — Jovon E Hayes
(74) *Attorney, Agent, or Firm* — Niro McAndrews, LLP

(57) ABSTRACT

Disclosed is an improved seat for toddlers on a dinghy or other small watercraft. The seat preferably includes two parallel rods that are each secured to the port and starboard sides of the watercraft. Draped between the rods is a loosely hanging fabric sheet that extends from the rods down to an elevation below the rods, but above the floor of the watercraft. In the sheet are leg holes through which a toddler's legs may extend. The placement of the toddler's legs through the holes helps to secure the toddler into the watercraft and keeps the toddler from being jostled when the smaller watercraft is bumped by waves or the wake of a larger vessel.

20 Claims, 12 Drawing Sheets

(56) References Cited

U.S. PATENT DOCUMENTS

| | | | | |
|---|---|---|---|---|
| 5,441,454 | A | 8/1995 | Race | 472/129 |
| 5,540,168 | A * | 7/1996 | Pettus | B63B 17/00 114/39.23 |
| 5,692,450 | A * | 12/1997 | Alter | B63B 1/121 114/255 |
| 5,762,403 | A * | 6/1998 | Robinson | A47C 5/06 297/440.11 |
| 6,240,872 | B1 * | 6/2001 | Zhou | B63B 7/06 114/354 |
| 6,334,402 | B1 | 1/2002 | Gilligan | 114/354 |
| 6,499,915 | B1 * | 12/2002 | Tayman | E02B 3/28 114/219 |
| 6,925,955 | B1 | 8/2005 | Brooks | 114/345 |
| 7,540,248 | B2 * | 6/2009 | London | B63B 1/121 114/352 |
| 8,438,985 | B2 * | 5/2013 | Scadden | B63B 7/08 114/345 |
| 8,800,467 | B2 * | 8/2014 | Temple | A01K 97/10 114/345 |
| 9,126,655 | B2 * | 9/2015 | Swan | B63B 7/087 |
| 2002/0089219 | A1 * | 7/2002 | Blanco | B60N 2/4221 297/284.4 |
| 2009/0288589 | A1 * | 11/2009 | Hammen | B63B 29/04 114/363 |
| 2011/0155042 | A1 | 6/2011 | Kaye | 114/354 |
| 2012/0017821 | A1 | 1/2012 | Mcdonough | 114/363 |
| 2013/0220208 | A1 | 8/2013 | Boyer | 114/363 |
| 2014/0026806 | A1 | 1/2014 | Hays | 114/363 |
| 2014/0109822 | A1 | 4/2014 | Eatwell | 114/363 |
| 2015/0000577 | A1 | 1/2015 | Santa Catarina | 114/39.26 |
| 2017/0073045 | A1 * | 3/2017 | Meyers | B63B 29/04 |

* cited by examiner

200

WATERCRAFT SEAT

FIELD OF THE INVENTION

The present invention relates generally to a seat for a watercraft and more particularly to toddler seating on a dinghy.

BACKGROUND OF THE INVENTION

When moving slowly, passengers of an inflatable watercraft often sit on the inflatable side chambers of the watercraft or on a rigid seat that extends between the two inflatable chambers. Ropes or handles are often provided on top of the inflatable chambers to help passengers hold on to the watercraft. When moving more quickly, passengers often sit or kneel on the floor of the dinghy or an interior seat. These seating positions function well for adults and older children, but fail to provide a safe and comfortable seating arrangement for toddlers on the watercraft.

SUMMARY OF THE INVENTION

The present invention provides an improved seat for toddlers on a dinghy or other small watercraft. The seat preferably includes two parallel rods that are each secured to the port and starboard sides of the watercraft. Draped between the rods is a loosely hanging fabric sheet that extends from the rods down to an elevation below the rods, but above the floor of the watercraft. In the sheet are leg holes through which a toddler's legs may extend. The placement of the toddler's legs through the holes helps to secure the toddler into the watercraft and keeps the toddler from being bumped when the small watercraft is jostled by waves or the wake of a larger vessel.

DETAILED DESCRIPTION

The present invention may be used in any instance where safe and comfortable seating for toddlers is needed and is particularly suited for seating toddlers on a watercraft. However, for descriptive purposes, the present invention will be described in use with inflatable dinghies.

Figure 1:
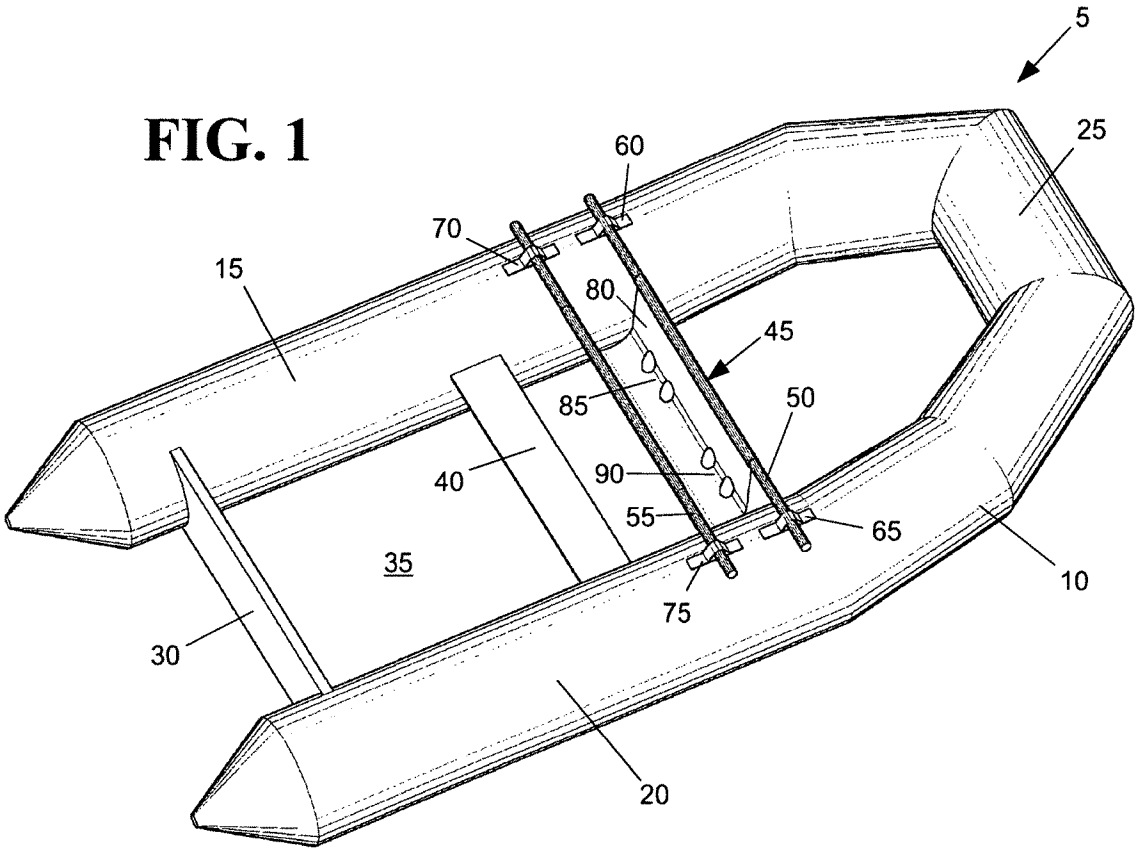
FIG. 1 shows a first perspective view of an inflatable watercraft having a toddler seat.
Figure 2:
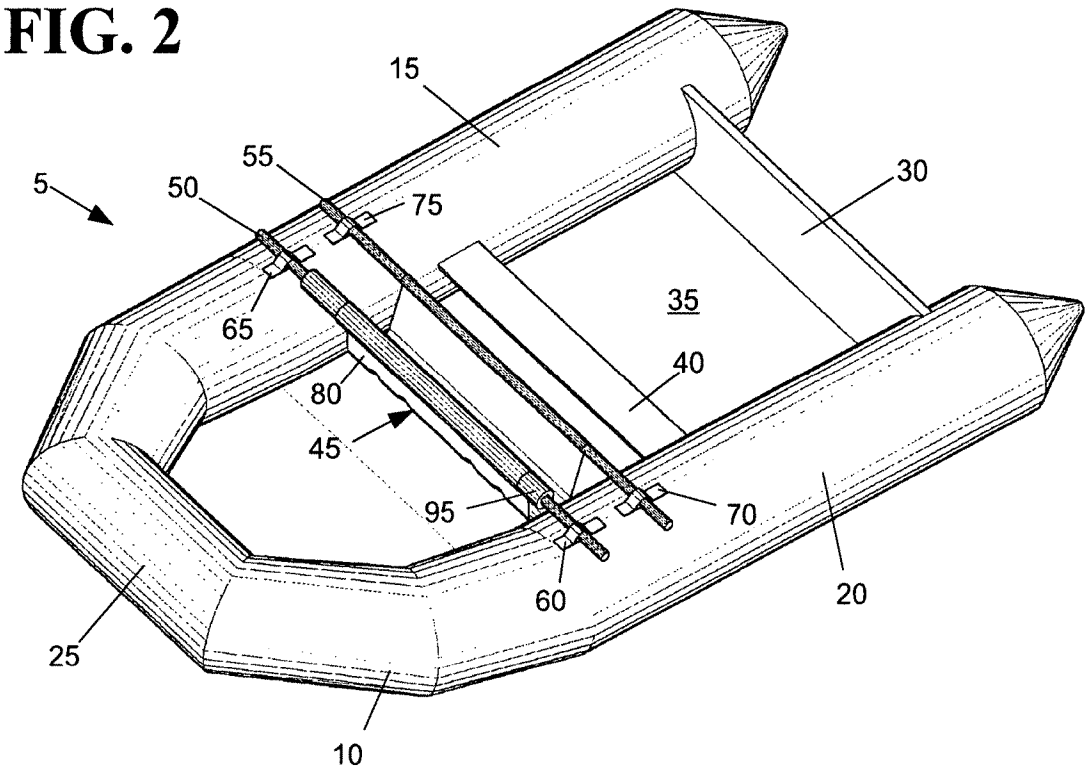
FIG. 2 shows a second perspective view of an inflatable watercraft having a toddler seat.
Figure 3:
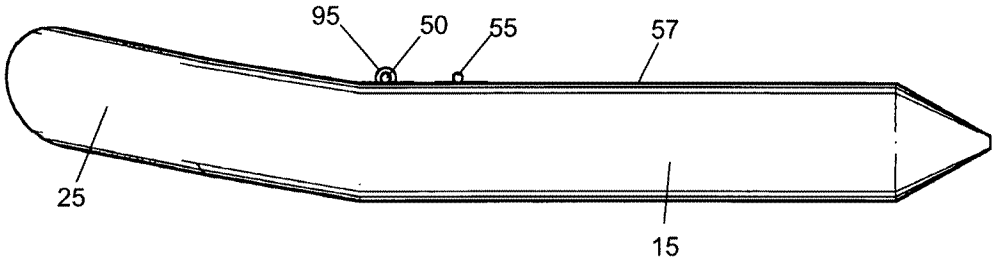
FIG. 3 shows a side view of a personal watercraft with a toddler seat having parallel shafts secured to the tops of the port and starboard sides of the inflatable hull.

FIGS. 1, 2, and 3 show an inflatable watercraft 5 with an inflatable hull 10 having a port side 15, a starboard side 20, and a bow side 25. In the illustrated example, the port and starboard sides (15, 20) of the hull are each formed by individual air chambers constructed from polyvinyl chloride (PVC) or chlorosulfonated polyethylene synthetic rubber. It should also be appreciated that the hull of the watercraft may be constructed from other materials such as wood, metal, or fiberglass.

A transom 30 extends between the port side 15 and the starboard side 20 of the inflatable hull 15 near the aft of the watercraft, and an engine (not shown) may be secured to the transom. A floor 35 is bounded by the inflatable hull 10 and the transom 30. Above the floor 35, and between the port and starboard sides (15, 20) of the hull 10, extends a board seat 40. The board seat 40 is secured to the port and starboard sides (15, 20) of the hull 10 through a variety of fasteners (not shown), such that the board seat 40 may only be installed or removed with a fair amount of difficulty.

Secured to both the port and starboard sides (15, 20) of the hull 10 is the toddler seat 45. The toddler seat includes a fore shaft 50 or pole that extends substantially parallel to an aft shaft 55 or pole. Both shafts (50, 55) are secured to the apexes/tops 57 of both the port and starboard sides (15, 20) of the hull 10 and extend horizontally. In the illustrated example, the shafts (50, 55) extend substantially parallel to each other and also extend substantially parallel to the transom 30, however it should be appreciated that the shafts may be oriented such that they are askew to the sides of the watercraft. In the illustrated example, the shafts are substantially uniform, however in other embodiments the shafts have unique shapes. For example, in one embodiment the fore shaft is constructed from a hollow PVC pipe while the aft shaft is constructed from a repurposed boat hook. By reusing items commonly found aboard vessels, the amount of storage space needed for the toddler seat is decreased.

First and second fore fasteners (60, 65) secure the fore shaft 55 to the inflatable hull while first and second aft fasteners (70, 75) are used to secure the aft shaft 55 to the inflatable hull. In the illustrated example, the fasteners each have a PVC or chlorosulfonated polyethylene synthetic rubber base secured to the hull and a similarly formed strap extending over their respective shaft. The inventors also contemplate that hook and loop type fabric may be used to form the straps over the shafts. In yet another embodiment, one set of fasteners includes oar locks that may also be used in combination with oars to propel the watercraft when not being used for the toddler seat. In yet another embodiment, the fasteners are the rope or handholds included with the dinghy that are designed to be held by older children and adults when the dinghy is in motion.

Loosely secured between both the fore and aft shafts (50, 55) is a sheet 80 having a first and second set of leg holes (85, 90). While the sheet may be constructed from a variety of different materials, in an exemplary embodiment the sheet is constructed from a woven acrylic fabric, a vinyl-coated polyester mesh, or another outdoor fabric adapted to be in a marine environment.

In the illustrated examples, the sheet 80 is secured to the shafts by wrapping around the shafts (or circumscribing them), however other methods of securing the sheet to the shafts may be used. For example, in one embodiment, the sheet has thick seams along its fore and aft edges that are secured into tracks in the fore and aft shafts, respectively. In FIGS. 2 and 3, the sheet is secured to the shafts by circumscribing the shafts, however the sheet 80 also circumscribes a cushion 95 or pad that surrounds the fore shaft. The cushion helps to protect the toddler if they are jostled forward by a wave or other disturbance. In the example shown in FIGS. 2 and 3, only the fore shaft is cushioned, however it should be appreciated that cushioning both the fore and aft shafts is within the scope of the invention. In yet another embodiment, neither of the shafts is cushioned.

Figure 4A:
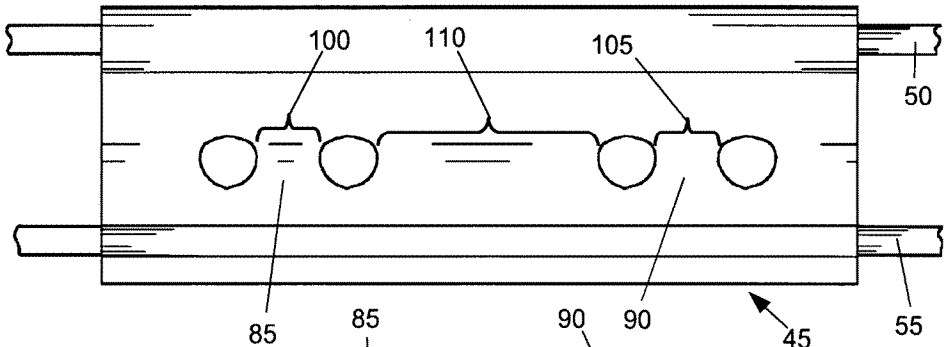
FIG. 4A shows an upper perspective view of an isolated toddler seat for a small watercraft.
Figure 4B:
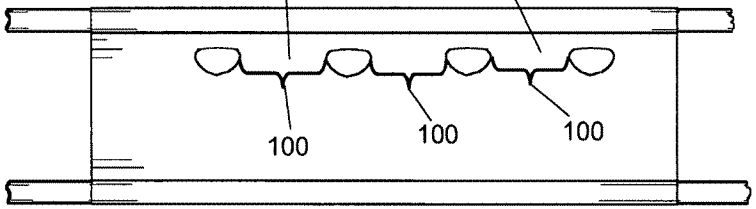
FIG. 4B shows an upper perspective view of an isolated toddler seat for a small watercraft.
Figure 5:
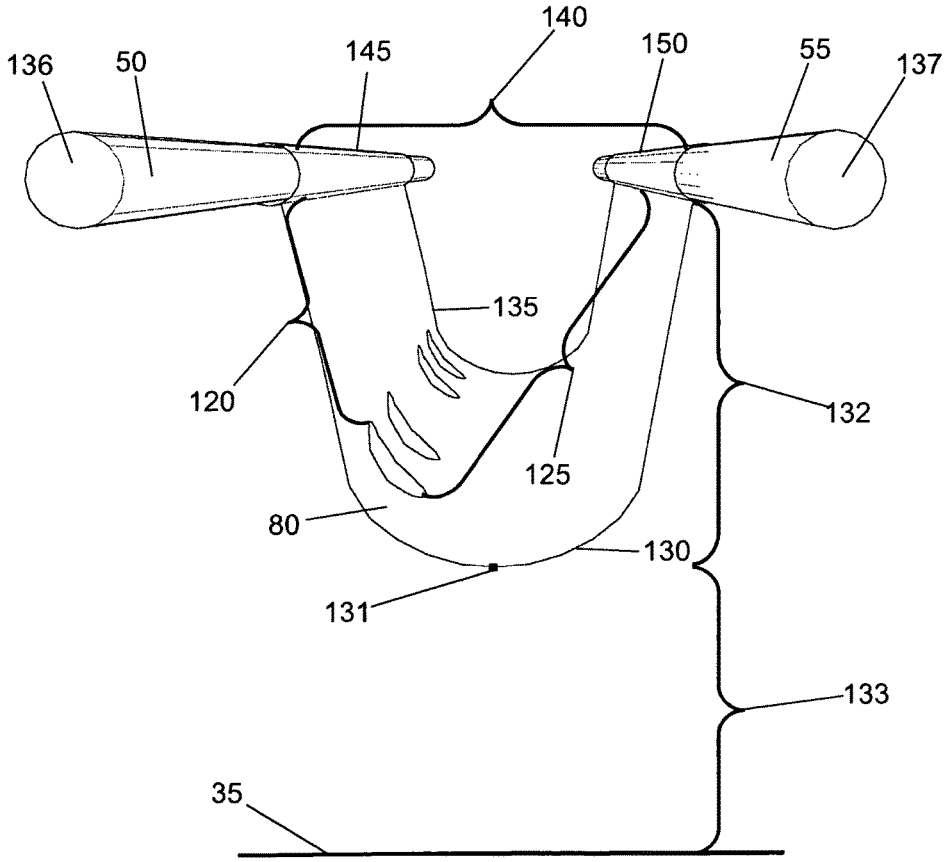
FIG. 5 shows an isolated side perspective view of an isolated toddler seat for a watercraft.

FIGS. 4A and 5 show isolated views of the toddler seat 45 with an aft shaft 55, and a cushion 95 around a fore shaft 50. In FIG. 4A, the leg holes of the first set of leg holes 85 are separated from each other by a first distance 100 while the second set of leg holes 90 are separated from each other by a second distance 105. In the illustrated example, the first distance 100 is equal to the second distance 105, however in alternate embodiments the first distance 100 will be smaller or larger than the second distance 105. For example, the second set of leg holes 90 may be adapted for use by a child older than the one using the first set of leg holes. To accommodate the older and larger child, the leg holes of the second set 90 will have a larger separation from each other. The first and second set of leg holes (85, 90) are separated from each other by a third distance 110. While it is generally expected that the first and second distances (100, 105) will be somewhat similar to each other, the third distance 110 is expected to generally be substantially larger than either the first distance 100 or the second distance 105 in some embodiments. In FIG. 4B, the leg holes are equidistant from each other and the spacing between leg holes is the first distance 100. In an exemplary example of the seat, the leg holes are circular and have a diameter of 3 inches such that the total area of each of the leg holes is about 7 square inches ($3.14\times(1.5\text{ inches})^2\approx 7$ square inches). In other embodiments, the leg holes have openings that are substantially larger than 7 square inches. In yet another embodiment, the holes have an opening size of at least 10 square inches. In yet another embodiment, the holes are roughly oval with a height of about 6 inches, a width of about 4 inches, and an area of about 20 square inches.

FIG. 5 shows a side perspective view of an isolated toddler seat 45. A first leg hole 115 is separated from the fore shaft 50 by a fourth distance 120 and separated from the aft shaft 55 by a fifth distance 125. In the illustrated example, the fourth distance 120 is less than the fifth distance 125 such that the leg holes are not symmetrical with regards to the fore and aft shaft (50, 55). By having the leg holes located closer to the fore shaft 50 it is more comfortable for the toddlers to sit in a position where they sit facing forward and are able to see where the watercraft is going. In the embodiments shown in FIGS. 1 through 5, the fore and aft shafts (50, 55) are interchangeable with each other such that the toddler seat may be positioned with the leg holes located closer to the aft shaft. The cushion 95 around the fore shaft 50 does not extend to the fasteners (60, 65, 70, 75) so any shaft may be secured within any fastener. Having the toddlers face the rear of the watercraft may be advantageous when the pilot (located near the transom) wishes to maintain a careful watch of the toddlers.

As shown in FIG. 5, the sheet 80 has a first width edge 130 or side that extends a distance substantially equal to a second width edge 135. The first width edge 130 and the second width edge 135 both extend from the fore shaft 50 to the aft shaft 55. The fore shaft 50 and the aft shaft 55 are separated from each other by a distance 140 that is substantially less than the length of either the first edge width 130 or the second edge width 135. In all of the illustrated examples of the toddler seat, the length of the first edge 130 is substantially greater than the distance 140 such that a toddler may be secured in the seat. In the illustrated example the length of the first edge 130 is at least twice the length of the distance 140, and in other examples the first edge 130 is at least three times the length of distance 140.

The sheet 80 also has a fore length edge 145 or side located adjacent to the fore shaft 50 and an aft length edge 150 or side located adjacent to the aft shaft 55. It should be appreciated that the length sides may be substantially rounded to match the shape of the shafts. In the illustrated example shown in FIG. 5, the fore and aft length edges (145, 150) have lengths that are similar to the separation of the sides of the hull such that the sheet nearly fully extends from the port side 15 of the inflatable hull 10 to the starboard side 20. In an alternate embodiment, the lengths of the length edges are much less than the separation of the sides of the hull. For example, the inventors contemplate a toddler seat designed for a single toddler where the length of the sheet is not substantially larger than the width of a single leg hole set.

In the illustrated example of FIG. 5 the sheet is snuggly wrapped around both the fore and aft shafts (50, 55) however in other embodiments the loops in the sheet have diameters twice the size of the shafts that are threaded through the loops. While fabric loops or tubes are used to secure the sheet to the shafts in the illustrated exemplary embodiment, in other embodiments discrete hard plastic loops (similar to those found in shower curtains) are used to secure the sheet to the shafts. In yet another embodiment, the end loops of the sheet include zippers such that the sheet may be installed around the shafts when the shafts have already been secured to the dinghy.

The sheet 80 includes a lowest point 131 that is a first vertical distance 132 from the fore and aft shafts (50, 55) and a second vertical distance 133 from the floor of the watercraft. In the illustrated example, the first vertical distance 132 is roughly equal to the second vertical distance 133 such that the lowest point of 131 of the sheet 80 is vertically midway between the shafts (50, 55) and the floor 35. The lowest point is at least 6 inches below the two holes due to the sheet extending substantially below the two poles. A sheet that extends substantially below the two poles is one with sufficient droop such that a toddler sitting on the lowest point cannot fall forward or backward out of the seat. A seat that sags more than 6 inches below the bottom of the poles is one that extends substantially below both the poles. In another exemplary embodiment, the second vertical distance 133 is at least 6 inches and the lowest point 131 of the sheet 80 is only about a quarter of the way from the floor 35 to the shafts (50, 55).

In the illustrated example, the fore shaft 50 extends a horizontal first length and has a fore cross section 136 that is perpendicular to the first length of the fore shaft. The aft shaft 50 has an aft cross section 137 that is perpendicular to the length of the aft shaft 55. While the inventors contemplate embodiments where the fore and aft shafts (50, 55) have unique cross sections and unique lengths, in the examples illustrated in FIGS. 1 through 7, the fore and aft shafts have substantially identical cross sections (136, 137) and substantially equal lengths.

In the illustrated example, the sheet hangs down from the shafts a vertical distance that is roughly half the separation of the shafts from the floor of the watercraft. By positioning the low point of the sheet substantially above the floor of the watercraft, the toddlers are able to comfortably extend their feet onto the floor. Additionally, in some embodiments, the hull of the watercraft is constructed from inflatable chambers that act as a cushion relative to the floor of the watercraft. When the watercraft is impacted by a wave, the bottom of the sheet may slightly move towards the floor thereby cushioning the impact of the wave. A substantial separation between the bottom of the sheet and the floor of the watercraft allows for the toddlers to move up and down relative to the floor with a reduced risk of them impacting the floor following a large wave.

Figure 6:
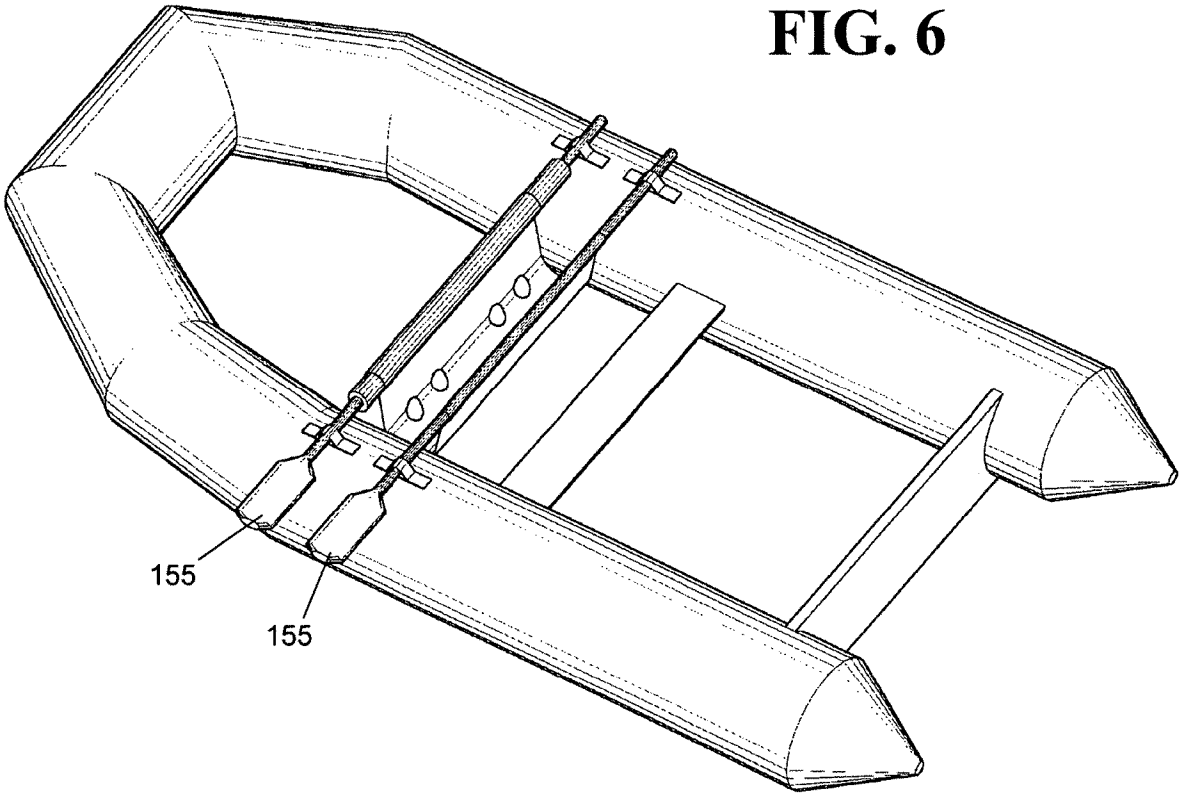
FIG. 6 shows a rear perspective view of an inflatable watercraft with a toddler seat, wherein the shafts of the toddler seat are constructed from oars and at least one of the shafts is cushioned.
Figure 7:
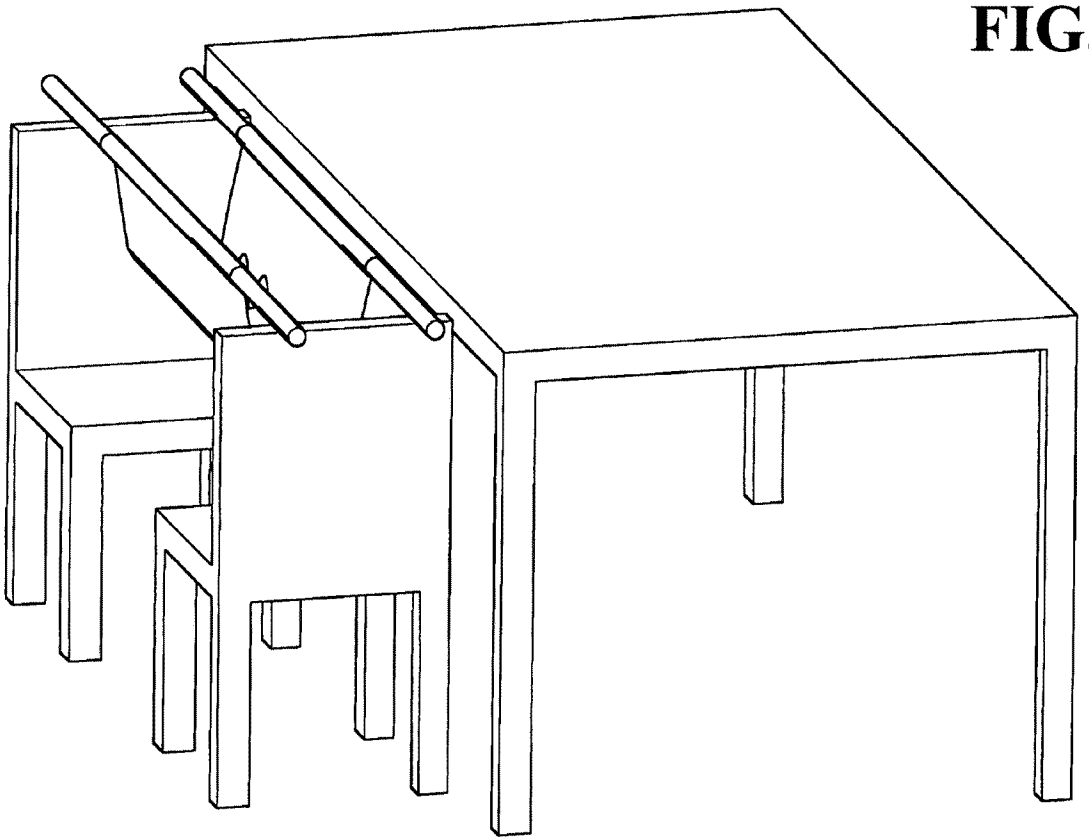
FIG. 7 shows a perspective view of a toddler seat used as a highchair.

FIG. 6 shows an embodiment where the shafts of the toddler seat are constructed from oars 155. In addition to reusing other items commonly found aboard vessels, in the event of engine trouble, the toddler seat may be disassembled so that the adult can use the oars to propel the watercraft. The poles of the oars 155 are telescoping such that they may be more compactly stored when the dinghy is not in use. Additionally, telescoping shafts that are not oars may also be used. FIG. 7 shows an example of the toddler seat being supported by two chairs to act as a highchair at a table.

Figure 8:
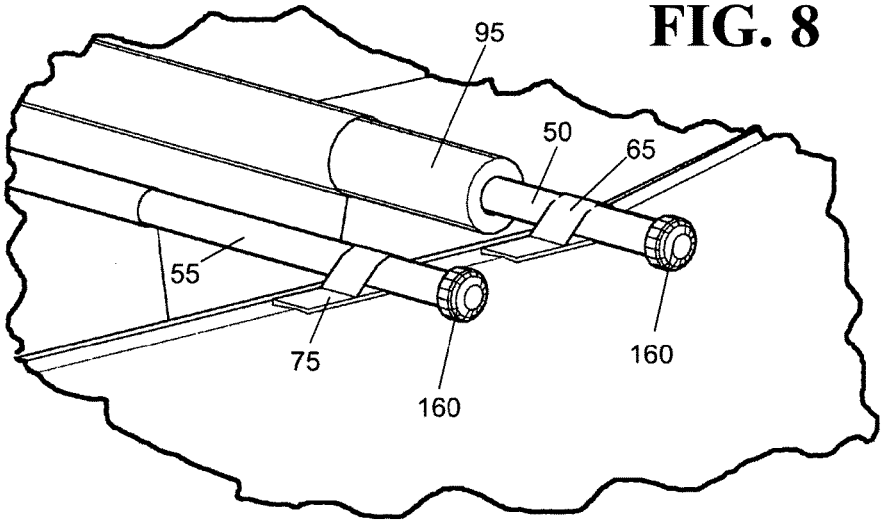
FIG. 8 shows a partial view of a toddler seat with rounded end caps on the shafts.

FIG. 8 shows an embodiment of the toddler seat with end caps 160 on both the fore and aft shafts (50, 55). In one embodiment, the shafts are constructed from hollow PVC tubes that are either an inch and a half or two inches in diameter and cut to match the width of the dinghy. When cut, the PVC tubing may left with relatively sharp ends that can scratch or damage the hull of a boat when the dinghy is secured alongside the larger vessel. To reduce the chance of damaging the boat, rounded end caps may be placed on the shafts. If both the caps and shafts are constructed from PVC, then the pieces may be secured together with a mixture of ketones (PVC cement), however if the end caps are made from rubber or foam then the inventors contemplate that other adhesives will be used. In another embodiment, the ends of the shafts are sanded down such that the ends are slightly rounded.

Figure 9A:
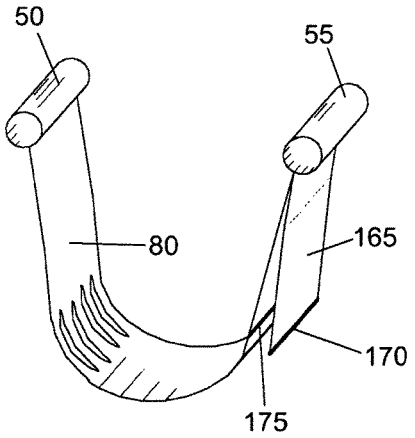
FIG. 9A shows an isolated view of a toddler seat with a cover in an undeployed configuration.
Figure 9B:
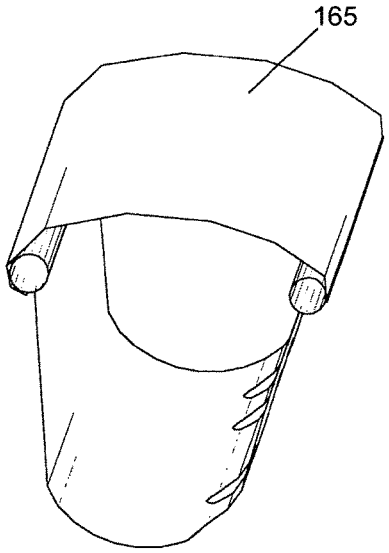
FIG. 9B shows an isolated view of a toddler seat with a cover in a deployed configuration.
Figure 10:
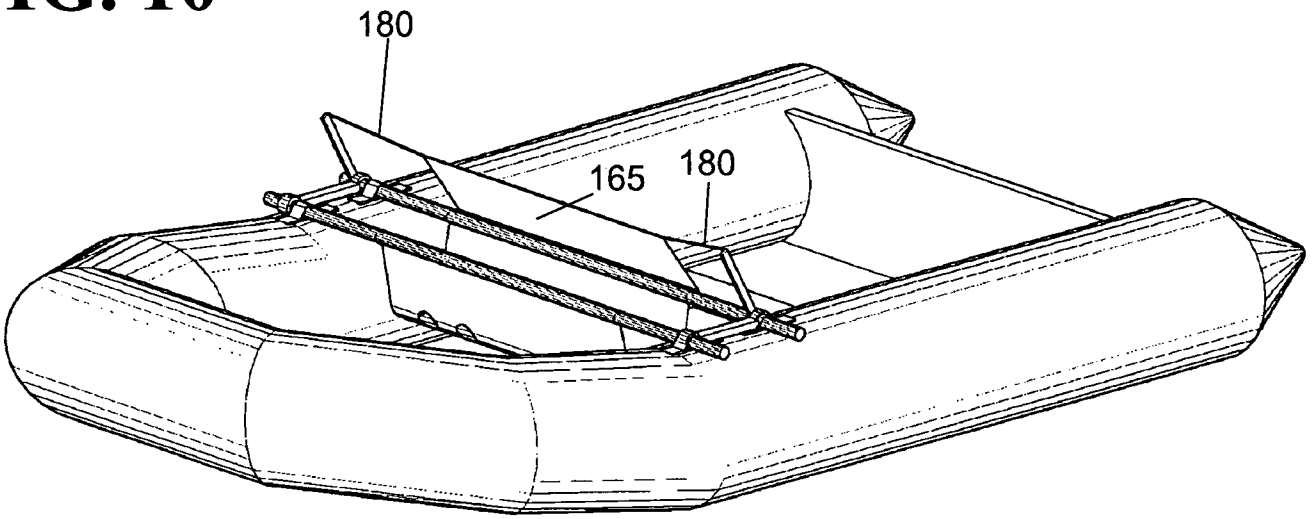
FIG. 10 shows a perspective view of a toddler seat with a cover in a canopy configuration.

FIGS. 9A and 9B show an example of a toddler seat that includes a flexible cover 165 secured to the fabric loop around the aft shaft 55. In FIG. 9A, the cover 165 includes a hook and loop fastener strip 170 that is configured to be secured to a complimentary hook and loop fastener band 175 on the sheet 80. When the cover 165 is not in use, the hook and loop strip and band (170, 175) are secured together to prevent the cover from flapping back and forth due to motion of the dinghy. FIG. 9B shows the cover in a use configuration where it extends from the aft shaft to the fore shaft. In an exemplary embodiment, there is a second hook and loop band near that fore shaft that connects with the hook and loop fastener strip 170 when the cover is in the use configuration. In yet another embodiment, the sheet is constructed from a woven vinyl mesh that allows water to pass through the seat while the cover is constructed from a water proof material so that items under the cover are protected from the rain. As shown in FIG. 10, the cover may also have a configuration where it acts as a canopy for the toddlers when the dinghy is in use. In the illustrated example, the cover 165 includes lines 180 that extend to upwardly rotated legs of spacers between the shafts.

Figure 11:
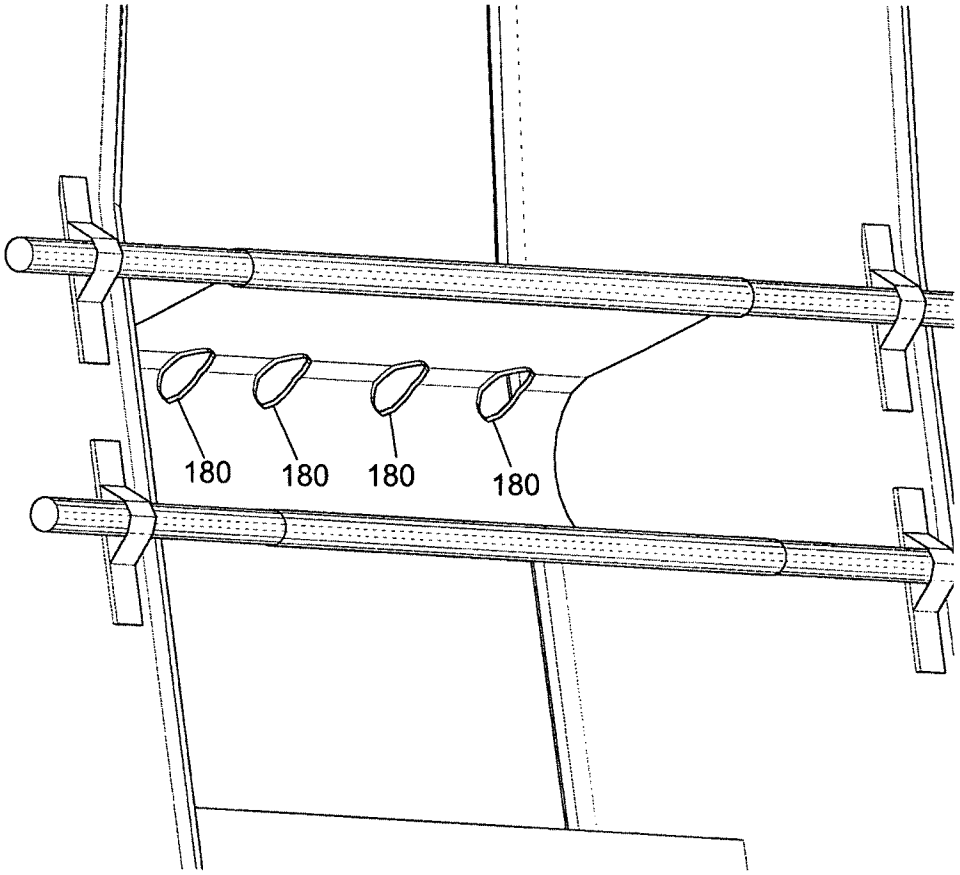
FIG. 11 shows a partial view of a toddler seat with extra fabric around the leg holes to prevent chaffing.

FIG. 11 shows a toddler seat that has padding 185 added around the leg holes in order to reduce chaffing on the toddlers' legs when they are seated. In an exemplary embodiment, the padding 185 is constructed of a dyed acrylic fabric while the remainder of the flexible sheet is made from a vinyl-coated polyester mesh.

Figure 12:
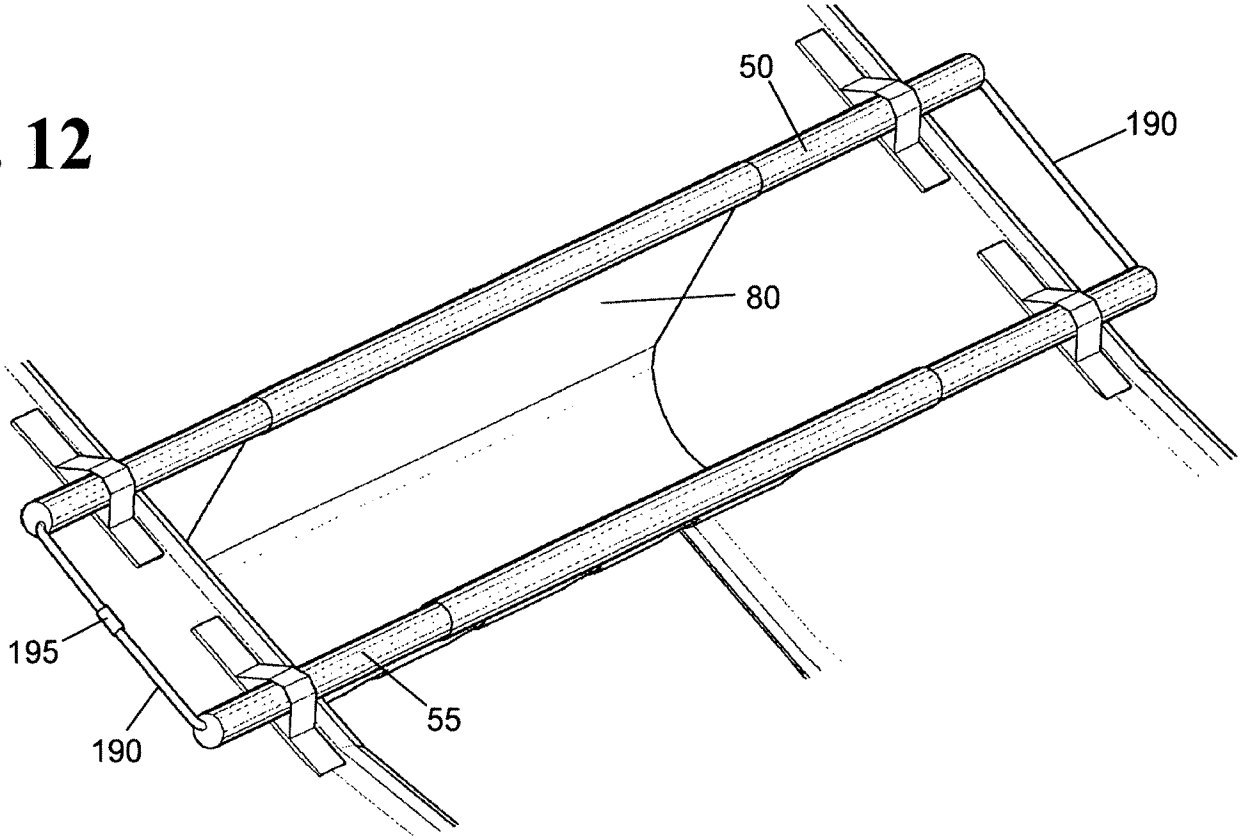
FIG. 12 shows a partial view of a toddler seat with a line extending through both hollow shafts to prevent the shafts from excessively shifting while the dinghy is in motion.

FIG. 12 shows a toddler seat with a line 190 extending through both the fore and aft shafts (50, 55) and being secured to itself with a clasp 195. In an exemplary embodiment, the shafts are constructed from hollow PVC pipes such that a standard nautical line may be threaded through them. As shown in FIG. 12, the line 190 may be looped through the shafts and secured to itself with a fastener/clasp 195 or with a knot. When the dinghy seat is used for extended periods of time and with larger children, the shafts may shift port or starboard relative to the rest of the dinghy. If they shift too far, the shafts may come out of the fore and aft fasteners potentially damaging the hull of the dinghy or injuring the toddlers in the seat. By looping the line through the shafts and around the fasteners, the shafts are better secured in the fasteners. The addition of a threaded line also makes removal of the seat somewhat more difficult and may be added by those wishing to make the seat a more permanent part of the dinghy. Alternatively, a bungee type engineered stretchable cord may be used between the shafts to better secure them in place. The inventors contemplate that the securing line will not be necessary in most instances while in use since the weight of the children in the seat will cause the shafts to press downward onto the hull of the dinghy, and the operator of the dinghy would easily notice a shift in the shafts.

Figure 13:
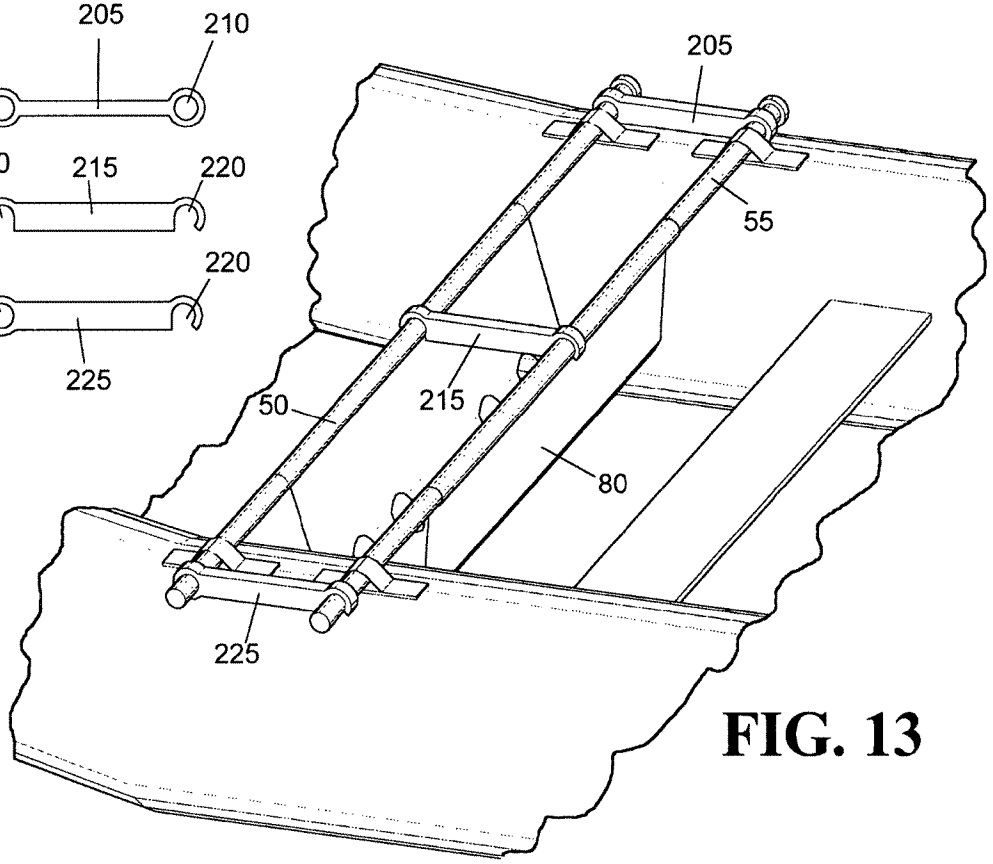
FIG. 13 shows a partial view of a toddler seat with three types of spacers acting to prevent the shafts from approaching each other.
Figure 14A:
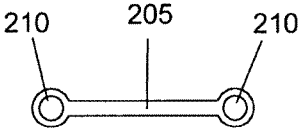
FIGS. 14A through 14C show isolated elevational views of three types of spacers.
Figure 14B:
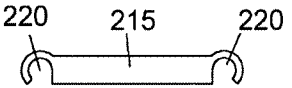
Figure 14C:
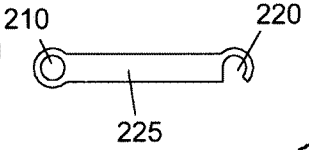

FIG. 13 shows a dinghy with three different types of spacers 200 limiting how close the shafts may move towards each other. Based on the design of the seat, when a toddler is sitting in the seat their weight will primarily cause the shafts to press downward on the hull of the dinghy, but since the sheet 80 is not pulling the shafts (50, 55) perfectly straight down there will be a small inwardly pulling force as well. To counter act the inwardly pulling force, a spacer or multiple spacers may be inserted between the shafts to keep them at a desired separation. For illustrative purposes, FIG. 13 shows three different types of spaces that are also shown in FIGS. 14A through 14C. The first spacer 205 has two full circular openings 210 through which the shafts may be slid. Since the spacer has features that fully circumscribe the shafts the spacer is able to keep the shafts well secured, but installing the spacer is a bit more difficult compared to the second spacer 215. The second spacer 215 has two snap around openings 220 such that the spacer may be installed simply by downwardly pressing it against the shafts. The third spacer 225 is a hybrid of the first spacer 205 and the second spacer 215 in that it has one full circular opening 210 and one snap around opening 220.

Figure 15:
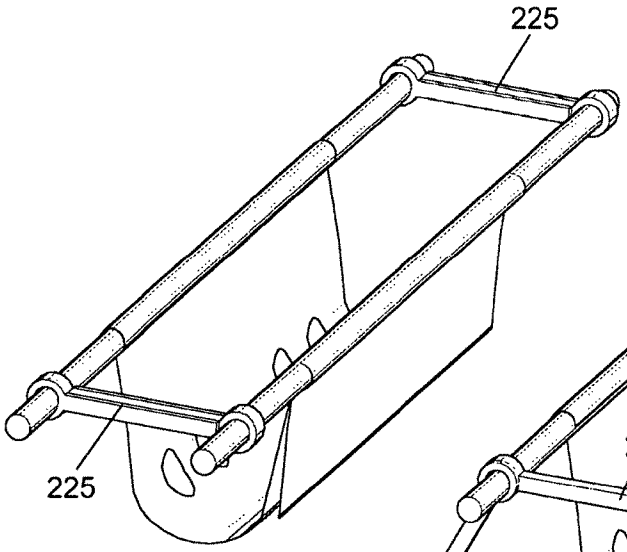
FIG. 15 shows an isolated view of a toddler seat with spacers having rotatable legs in an undeployed configuration.
Figure 16:
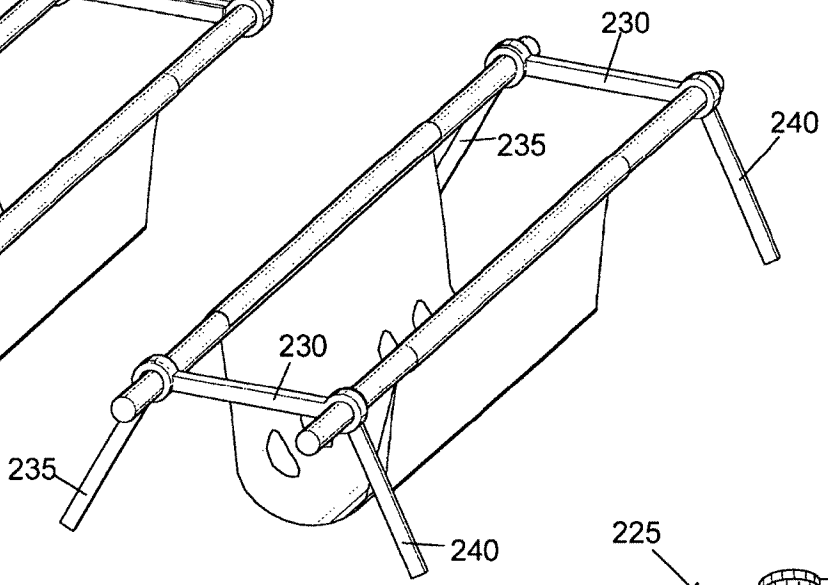
FIG. 16 shows an isolated view of a toddler seat with spacers having rotatable legs in a deployed configuration to form a beach chair.
Figure 17:
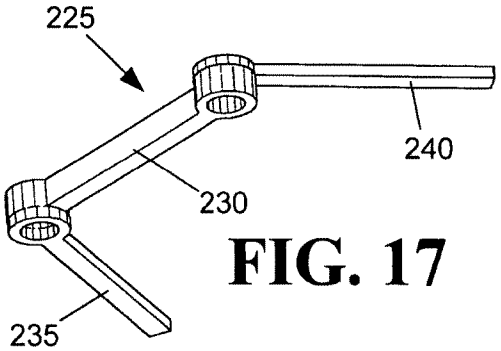
FIG. 17 shows an isolated view of one of the spacers of FIG. 16.

FIGS. 15 through 17 illustrate a fourth type of spacer 225 that includes a horizontal bar 230 that spans between the two shafts along with a first leg 235 and a second leg 240 that rotate relative to the horizontal bar 230. When the fourth spacer 225 is used in on a dinghy, the fourth spacer 225 has a configuration where the first and second legs (235, 240) are directly adjacent to the horizontal bar 230. FIG. 16 shows the spacers in a beach chair configuration when the first leg 235 and the second leg 240 have been rotated away from the horizontal bar 230. By simply removing the toddler seat from the dinghy and rotating the legs, the seat can be used in a multitude of situations.

The inventors contemplate several alterations and improvements to the disclosed invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the specific examples described.

We claim:

1. A watercraft comprising:
a hull with a starboard side and a port side;
a first shaft extending substantially parallel to a second shaft,
each shaft secured to both the starboard side and the port side of the hull, and
the entire first shaft separated from the second shaft by at least a first distance;
a sheet having
a first length side secured to the first shaft and
a second length side secured to the second shaft,
wherein the sheet has a width side at least two times longer than the first distance,
the width side having a lowest vertical point, and
the lowest vertical point located at least six inches below the first shaft.

2. The watercraft of claim 1 wherein
the sheet includes a first toddler leg hole separated from a second toddler leg hole.

3. The watercraft of claim 2 wherein
the first toddler leg hole is a second distance from the first shaft,
the first toddler leg hole is a third distance from the second shaft, and
the third distance is greater than the second distance.

4. The watercraft of claim 3 further comprising
a spacer with a first snap around opening and a second opening separated by the first distance,
the first shaft rotatably secured in the first snap around opening,
the second shaft secured in the second opening;
wherein
the first toddler leg hole is separated from the second toddler leg hole by a fourth distance,
the sheet includes a third toddler leg hole separated from a fourth toddler leg hole by a fifth distance,
the third toddler leg hole separated from the second toddler leg hole by a sixth distance,
the fourth distance being equal to both the fifth distance and the sixth distance.

5. The watercraft of claim 3 further comprising:
a floor extending from the port side of the hull to the starboard side of the hull;
the sheet having a lowest point;
the lowest point vertically distant from
the first shaft,
the second shaft, and
the floor.

6. The watercraft of claim 5 wherein
the lowest point of the sheet is at least 6 inches from the floor.

7. The watercraft of claim 1 wherein
the first shaft is secured above both the port and starboard sides of the hull,
the second shaft is secured above both the port and starboard sides of the hull, and
the sheet is a vinyl-coated polyester mesh.

8. The watercraft of claim 1 wherein
the width side is at least three times the length of the first distance,
the first shaft is a first oar and
the second shaft is a second oar.

9. The watercraft of claim 1 further comprising
the first shaft linearly extending from a first end to a second end,
the second shaft linearly extending from a third end to a fourth end,
the first end separated from the third end by the first distance,
the second end separated from the fourth end by the first distance,
the sheet located between and extending between the starboard side and the port side, and
the sheet circumscribing both the first shaft and the second shaft.

10. The watercraft of claim 1 wherein
the sheet circumscribes the first shaft,
a pad circumscribes the first shaft, and
the pad is located between the sheet and the first shaft.

11. The watercraft of claim 1 wherein
the hull of the watercraft is inflatable, and
a first fabric fastener secures the first shaft to the starboard side of the hull, and
the first fabric fastener is constructed of a material selected from a group consisting of polyvinyl chloride and chlorosulfonated polyethylene synthetic rubber.

12. A seat for a toddler comprising:
a first horizontal pole;
a second horizontal pole extending parallel to the first horizontal pole, the entire first horizontal pole is separated from the second horizontal pole by a first distance;
a sheet with
a first leg hole set,
a first length side secured to the first horizontal pole,
a second length side secured to the second horizontal pole,
a first width side
extending from the first length side to the second length side,
extending substantially below both
the first horizontal pole and
the second horizontal pole,
having a lowest vertical point located at least six inches below the first horizontal pole, and
the first width side having a length of a second distance that is at least twice as long as the first distance.

13. The seat of claim 12 wherein
the first leg hole set is separated from the first horizontal pole by a third distance,
the first leg hole set is separated from the second horizontal pole by a fourth distance, and
the third distance is greater than the fourth distance.

14. The seat of claim 12 further comprising
the first leg hole set including a first leg opening separated from a second leg opening by a fifth distance;
a second leg hole set including a third leg opening separated from a fourth leg opening by a sixth distance;
the first leg hole set separated from the second leg hole set by a seventh distance that is greater than both the fifth distance and the sixth distance; and
the first distance is equal to the second distance.

15. The seat of claim 12 further comprising
a cover with
a cover length side secured to the first horizontal pole,
the cover length side and the first length side of the sheet having equal lengths,
a cover first width side
extending from the cover length side to the second horizontal pole and
extending above both
the first horizontal pole and
the second horizontal pole; and
wherein
the sheet circumscribes both the first horizontal pole and the second horizontal pole.

16. The seat of claim 12 wherein
the first horizontal pole has a first pole length and a first cross section perpendicular to the first pole length,
the second horizontal pole has a second pole length and a second cross section perpendicular to the second pole length,
the first cross section is substantially identical to the second cross section, and
the first pole length is substantially equal to the second pole length.

17. The seat of claim 16 further comprising
a spacer with a first spacer opening and a second spacer opening,
the first pole in the first spacer opening,
the second pole in the second spacer opening, and
the sheet located within both the first spacer opening and the second spacer opening;
wherein
the sheet is constructed from a woven acrylic fabric.

18. A watercraft comprising:
a hull with a starboard side and a port side;
a floor extending between the port and starboard sides of the hull;
a first pole secured to both the port and starboard sides of the hull;
a second pole secured to both the port and starboard sides of the hull;
a sheet
secured to both the first and second poles,
extending between the port and starboard sides of the hull, and
having a lowest point;
the lowest point vertically distant from
the floor,
the first pole, and
the second pole;
the first pole is a first oar; and
the second pole is a second oar.

19. The watercraft of claim 18 wherein
a first fastener directly secures the first pole to the starboard side of the hull;
a second fastener directly secures the first pole to the port side of the hull;
a third fastener directly secures the second pole to the starboard side of the hull;
a fourth fastener directly secures the second pole to the port side of the hull;
the first pole extends horizontally between the port and starboard sides of the hull;
the second pole extends horizontally between the port and starboard sides of the hull;
the sheet includes a plurality of leg holes; and
each of the leg holes has an opening area of at least ten square inches.

20. A seat for a watercraft having a hull with a starboard side and a port side, the seat comprising:
a first shaft extending substantially parallel to a second shaft,
each shaft configured to be secured to both the starboard side and the port side of the hull, and
the first shaft separated from the second shaft by a first distance;
a sheet having
a first length side secured to the first shaft and
a second length side secured to the second shaft,
wherein the sheet has a width side at least two times longer than the first distance; and
a spacer with a first snap around opening and a second opening separated by the first distance,
the first shaft rotatably secured in the first snap around opening, and
the second shaft secured in the second opening.

* * * * *